US005078002A

United States Patent [19]

Bozzi et al.

[11] Patent Number: 5,078,002

[45] Date of Patent: Jan. 7, 1992

[54] HYDRAULIC ASSEMBLY TO ACTUATE FORGING PRESSES

[75] Inventors: Eugenio Bozzi, Monza; Antonio Durí, Pradamano, both of Italy

[73] Assignee: Danieli & C. Officine Meccaniche SpA, Buttrio, Italy

[21] Appl. No.: 620,055

[22] Filed: Nov. 30, 1990

[30] Foreign Application Priority Data

Dec. 13, 1989 [IT] Italy ..... 83528 A/89

[51] Int. Cl.[5] ..... B21J 9/14

[52] U.S. Cl. ..... 72/453.02; 72/402; 72/444

[58] Field of Search ..... 72/402, 399, 453.01, 72/453.08, 76, 403, 407, 444, 453.02, 405

[56] References Cited

U.S. PATENT DOCUMENTS

| | | | |
|---|---|---|---|
| 3,654,789 | 4/1972 | Brauer | 72/402 |
| 3,746,184 | 7/1973 | Wallis | 72/405 |
| 3,893,327 | 7/1975 | Fedorov et al. | 72/402 |
| 4,118,151 | 10/1978 | Murakami | 417/223 |
| 4,391,120 | 7/1983 | Trevarrow | 72/405 |
| 4,434,645 | 3/1984 | Svercl et al. | 72/402 |
| 4,745,793 | 5/1988 | Pahnke | 72/453.01 |

FOREIGN PATENT DOCUMENTS

| | | | |
|---|---|---|---|
| 0236589 | 9/1987 | European Pat. Off. . | |
| 2030471 | 1/1971 | Fed. Rep. of Germany . | |
| 1917511 | 7/1973 | Fed. Rep. of Germany . | |
| 2072109 | 9/1971 | France . | |
| 1020348 | 2/1966 | United Kingdom | 72/402 |

*Primary Examiner*—David Jones

*Attorney, Agent, or Firm*—Antonelli, Terry, Stout & Kraus

[57] ABSTRACT

Hydraulic assembly to actuate forging presses (21), which comprises two pairs of hydraulic pumps (17–18) arranged at the ends of the forging presses (21) thus served and in close proximity thereto, a reduction gear unit (16) and a motor (11), at least one brake/clutch unit (20) being included between the motor (11) and the pairs of hydraulic pumps (17–18).

5 Claims, 2 Drawing Sheets

HYDRAULIC ASSEMBLY TO ACTUATE FORGING PRESSES

This invention concerns a hydraulic assembly to actuate forging presses. To be more exact, the invention concerns the structure and composition of the hydraulic assembly that actuates the forging presses.

The state of the art is described in U.S. Pat. No. 4,745,793 (EP 0236589). It is known that the hydraulic assemblies serving hydraulic forging presses have to be always kept in motion, whereas the forging hammers have to be halted regularly to change the oil in the compression circuit.

The hydraulic actuation assemblies have to be always kept in motion because the motor possesses a considerable inertia owing to the geometric dimensions which it has to have so as to be able to drive the actuation assemblies.

Such inertia entails long times to halt the motor and all the parts set in rotation by the motor and also entails long times for start-up. Moreover, the inertia is accentuated by the flywheels included in cooperation with the actuation assemblies.

Such long times are not compatible with the times involved in the cycle and with the need to use a forging press, so that at the present time the trend is to make these times correspond to the times required to change the workpiece to be forged.

It should be borne in mind that the stoppages to change the oil in modern forging presses may take place even every 10 to 15 minutes, and this fact will give an idea of the problems which would arise if it were necessary to stop and re-start the known actuation assemblies whenever the oil has to be changed.

It is also known that the change of oil takes place by using pairs of on-off valves, which close the circuit towards the expansion chambers of the press and towards the reservoir of the oil at rest.

These pairs of valves become unserviceable after a given number of cycles owing to the heavy duties which they perform. Moreover, they are very complex to regulate and are hard and complex to synchronize, so that faulty timings can readily occur.

Furthermore, it is known that the wear of the gears of the reduction gear unit, which provides motion for the four actuation assemblies consisting of hydraulic pumps, is not even, and therefore the gears providing motion to one pair of hydraulic pumps become worn more than the gears providing motion to the other pair of hydraulic pumps, thus leading to problems of uneven efficiency and anomalous concentrated stresses.

The reduction gear unit has to be made considerably oversized so as to obviate these problems In fact, as can be seen also in U.S. Pat. No. 4,745,793 (EP 0236589), the four hydraulic pumps are positioned two by two coaxially and the two pairs are positioned with their axes parallel and are set in rotation simultaneously by one single reduction gear unit.

The state of the art provides a rigid connection between the motor and the pumps, and this connection is further emphasized by the inclusion of the flywheels. This rigidity has been found unhelpful for good working; in fact, the shock waves leaving the press affect firstly the pumps and therefrom rebound on the reduction gear unit and lastly on the motor, often with a pulsating thrust action.

Moreover, under given conditions the system of pumps tends to undergo an accelerating action, which is discharged onto the reduction gear unit and thence onto the motor.

The motor, which is in fact an electric motor, has a constant speed of rotation, this too owing to its physical dimensions, and the anomalous stresses are therefore discharged abruptly onto a kinematic system which is in fact rigid owing to its inertia and which therefore behaves as a wall against such acceleration.

This rigidity of the mechanical system leads to great stresses in the reduction gear unit and pumps together with problems of anomalous wear, cracks and resulting breakages.

To obviate these problems, all the parts have therefore to be considerably overdimensioned.

These problems have been tackled and overcome by the present applicant, who has designed, tested and embodied this invention for that purpose.

According to the invention a brake/clutch unit is included between the motor and the pumps. This brake/clutch unit enables the hydraulic pumps to be stopped without having to stop the motor and with stoppage and start-up times compatible with the times of the cycle and with the requirements of employment of the system. Moreover, it enables the inclusion of valves or gate valves to be obviated, thus avoiding the regulation thereof as well.

According to a variant the hydraulic pumps are coupled in pairs and each pair is positioned in series on one single axis so that the output of motion of the first pair of hydraulic pumps provide motion for the second pair of hydraulic pumps.

This lay-out enables the synchronization of the four hydraulic pumps to be definitely achieved with means independent of the reduction gear unit.

According to a further variant the rigid connection between the motor and the brake/clutch unit is eliminated and transmission belts are included to connect the motor to the brake/clutch unit.

These belts can thus absorb the pressure-wave blows and accelerations of the system by means of the belts sliding on their pulleys.

The attached figures, which are given as a non-restrictive example, show a preferred embodiment of the invention as follows.

Figure 1:
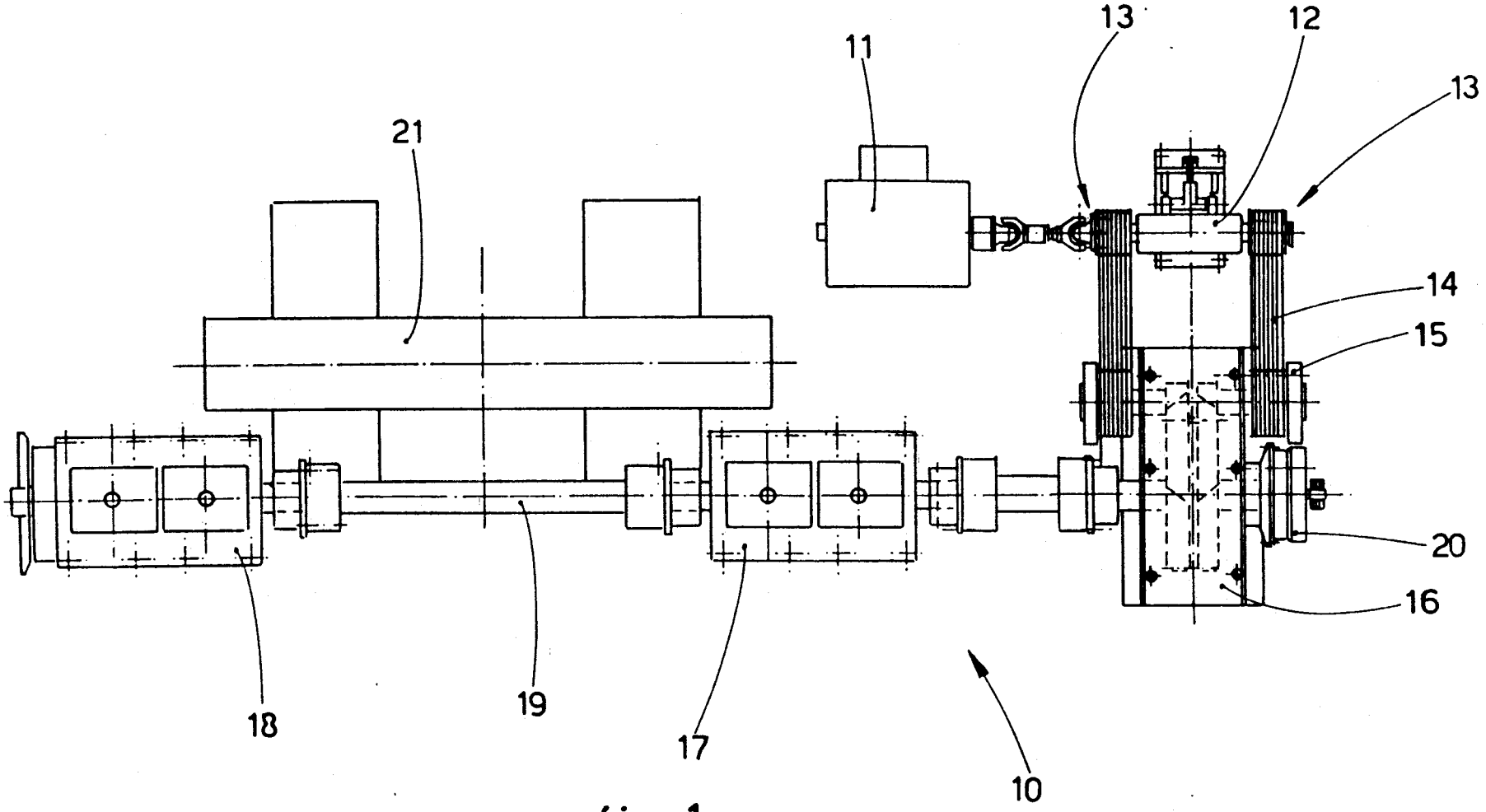
FIG.1 shows a diagrammatic plan view of an assembly of hydraulic pumps according to the invention.

In FIG.1 a motor 11 provides morion for a shaft 12 that bears two pulleys 13, which set in rotation respective belts assemblies 14, which in turn set in rotation pulleys 15 of a reduction gear unit 16. The reduction gear unit 16 actuates pairs of hydraulic pumps 17 and 18 positioned in series substantially on the same axis.

A hydraulic assembly 10 comprises two pairs of hydraulic pumps 17–18 that feed cylinders which actuate hammers of a forging press 21. Each pair comprises two pumps on the same axis and the two pairs 17–18 are connected on the same axis in a substantially rigid manner by a shaft 19.

The two pairs of pumps 17–18 are thus synchronized by their own means and are located at the ends of the forging press 21, being correctly positioned in the proximity of the respective cylinders to be actuated, so that the fluid has to run only along a short distance with very small losses of load.

This makes unnecessary the inclusion of the usual valves or gate valves to change the oil, for such valves break readily and themselves are points for losses of load.

The first pair of hydraulic pumps 17 is set in rotation by the reduction gear unit 16 and sets in rotation the second pair of hydraulic pumps 18 by means of the shaft 19.

In this example a brake/clutch unit 20 is positioned between the reduction gear unit 16 and the first pair of hydraulic pumps 17 but may be positioned also between the motor 11 and the reduction gear unit 16.

The brake/clutch units 20 are of a known type available on the market for a long time now and have therefore not been shown here.

In relation to the determined physical condition of the brake/clutch unit 20, the pairs of pumps 17–18 are set in rotation by the reduction gear unit 16 through the clutch or else are kept stationary and inactive by the brake.

By means of the lay-out according to the invention the pair of hydraulic pumps 17 actuates two hammers (lower and upper) located at one end of the forging press 21, whereas the pair of hydraulic pumps 18 actuates the other two hammers of the forging press 21.

In this example the reduction gear unit 16 is set in rotation by two belt assemblies 14, which operate on drive pulleys 13 and driven pulley 15, the drive pulleys 13 obtaining motion from a motor 11.

In this example, as we said earlier, two pairs of pulleys 13–15 and two belt assemblies 14 have been included for a necessary sharing of the load. The drive pulleys 13 in this case are supported on a journalled shaft 12.

This invention achieves in fact not only the advantages listed in U.S. Pat. No. 4,745,793 but also further advantages as compared to U.S. Pat. No. '793.

Figure 2:
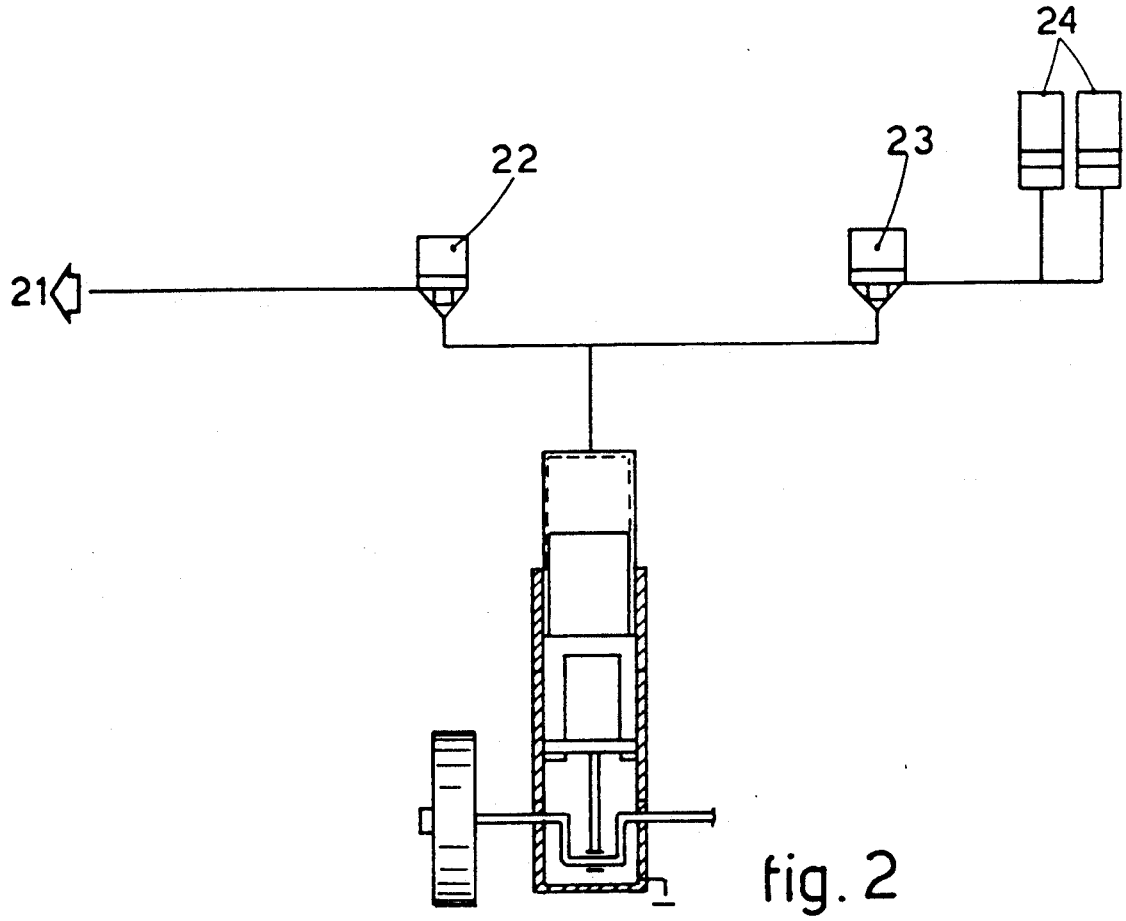
FIG.2 shows a summarized diagram of a hydraulic circuit of a known type.

According to the state of the art two valves, 22 for functioning and 23 for changing the oil, have to be provided together with accumulator tanks 24 to halt the hammers (all the control and assistance circuits have been left out of the diagram of FIG.2 for simplification purposes). The valve 22 is kept open during working, while the valve 23 is closed; when the hammers have to be halted, the valve 22 is closed while the valve 23 is opened; in the meantime the hydraulic pumps continue working.

Figure 3:
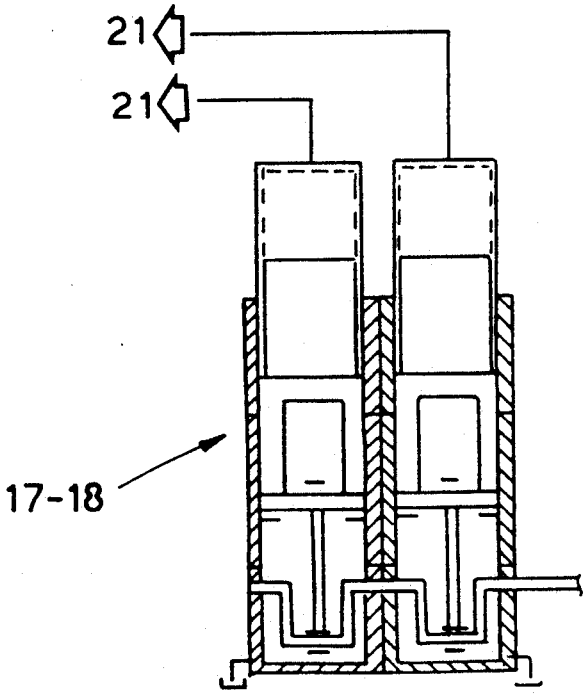
FIG. 3 shows a summarized diagram of a hydraulic circuit of the type obtained with the invention.

Instead, according to the invention it is enough to act on the brake/clutch unit 20 and to halt the pairs of pumps 17–18 momentarily, thus eliminating every valve (see FIG.3) and simplifying the auxiliary circuits too (not shown here) as much as possible.

Moreover, start-up can take place after cutting out the pairs of pumps 17–18 by means of the brake/clutch unit 20, thereby reducing times and consumption.

Furthermore, the unbalanced loads are partly compensated between the two pairs of pumps 17–18.

The accelerations which occur in the pairs of pumps 17–18 and the loads of unbalance are absorbed by the belt assemblies 14.

According to a variant two D.C. motors with start/-stop actuation may be included on the same axis as the pairs of pumps 17–18.

We claim:

1. A hydraulic assembly to actuate forging presses, comprising:

two pairs of hydraulic pumps, each pair of hydraulic pumps comprising two pumps coupled in series on a single axis, said single axis being parallel to a frontal surface of the forging presses served by the pumps, and said two pairs of pumps being rigidly connected together in series on said single axis, whereby a first pair of said two pairs of hydraulic pumps provides motion to a second pair of said two pairs of hydraulic pumps;

a reduction gear unit for actuating said two pairs of hydraulic pumps;

a motor for actuating said reduction gear unit; and a brake/clutch unit provided between said motor and said two pairs of hydraulic pumps for selectively allowing actuation of braking of said two pairs of hydraulic pumps.

2. Hydraulic assembly as claimed in claim 1 in which at least one transmission belt assembly is included between the motor and the reduction gear unit.

3. Hydraulic assembly as claimed in claim 1, in which the brake/clutch unit is positioned between the motor and the reduction gear unit.

4. Hydraulic assembly as claimed in claim 8, in which the brake/clutch unit is positioned between the reduction gear unit and the pairs of hydraulic pumps.

5. Hydraulic assembly as claimed in claim 8, in which two motors with start-stop actuation are included at the two ends of the pairs of hydraulic pumps.

* * * * *

UNITED STATES PATENT AND TRADEMARK OFFICE

CERTIFICATE OF CORRECTION

PATENT NO. : 5,078,002

DATED : January 7, 1992

INVENTOR(S) : BOZZI, et al

It is certified that error appears in the above-identified patent and that said Letters Patent is hereby corrected as shown below:

Section [75], Title Page, delete "Antonio" and insert --Antonino--.

Signed and Sealed this

Twenty-seventh Day of April, 1993

*Attest:*

MICHAEL K. KIRK

*Attesting Officer*

*Acting Commissioner of Patents and Trademarks*